United States Patent [19]

Roscizewski

[11] Patent Number: 4,779,341

[45] Date of Patent: Oct. 25, 1988

[54] METHOD OF USING A TAP PLUG INSTALLATION TOOL

[75] Inventor: Paul M. Roscizewski, Franksville, Wis.

[73] Assignee: RTE Corporation, Brookfield, Wis.

[21] Appl. No.: 107,820

[22] Filed: Oct. 13, 1987

[51] Int. Cl.[4] ..... B25B 27/14; H01R 13/52

[52] U.S. Cl. ..... 29/876; 29/271; 439/475

[58] Field of Search ..... 29/876, 271; 439/306, 439/475, 607, 921

[56] References Cited

U.S. PATENT DOCUMENTS

| | | | |
|---|---|---|---|
| 4,202,591 | 5/1980 | Borgstrom | 439/607 X |
| 4,354,721 | 10/1982 | Luzzi | 439/475 |
| 4,715,104 | 12/1987 | Schoenwetter et al. | 29/271 |

*Primary Examiner*—P. W. Echols
*Assistant Examiner*—Taylor J. Ross
*Attorney, Agent, or Firm*—James Earl Lowe, Jr.

[57] ABSTRACT

An installation tool comprising an elongated shaft having a threaded section and a blunt section, the tool having a threaded opening in one end and a hex opening in the other end. The installation tool is used to assemble a loadbreak reducing tap plug including a threaded mounting bolt mounted in the threaded end of the plug, and a threaded cable connector mounted in a visible-break "T" type connector housing, by the following method. Turning the threaded mounting bolt into the threaded opening of the installation tool. Turning the tool threaded section into the cable connector. Turning the tap plug into the cable connector. And removing the tool from the cable connector.

2 Claims, 1 Drawing Sheet

14
18
10
22
26
30
34
38
42
46
50
54
58
62
66
70
74
78
82
86
90
92
94
98
100
104

METHOD OF USING A TAP PLUG INSTALLATION TOOL

BACKGROUND OF THE INVENTION

This invention relates to a method of using a tool for connecting a loadbreak reducing tap plug to a connector such as a threaded cable connector located in a visible-break "T" connector housing.

A loadbreak "T" connector housing is used to establish a visible ground connection to the circuit elements of a high voltage power distribution circuit. The installation of a loadbreak reducing tap plug into the visible break housing is usually accomplished by inserting the reducing tap plug into the "T" housing and axially aligning a threaded end of the plug with a threaded opening in a cable connector located within the housing. Once aligned, the plug is rotated to screw the threaded end into the threaded opening. Since an interference fit is required between the plug and the "T" connector housing in order to prevent the ingress of water and other contaminates, it is difficult to accurately align the threaded end of the tap plug with the threaded opening in the cable connector, while at the same time forcing the interference fit relationship between the plug and the "T" housing. Because of this difficulty, the threaded end of the tap plug can frequently become cross-threaded with the connector.

Installation tools have previously been provided for assisting in the assembly of a loadbreak reducing tap plug and a threaded cable connector located in a visible break "T" connector housing. One such tool is disclosed in U.S. Pat. application Ser. No. 908,843 filed Sept. 18, 1986 and owned by the same assignee as this application.

Attention is also directed to U.S. Luzzi Pat. No. 4,354,721 issued Oct. 19, 1982.

SUMMARY OF THE INVENTION

One of the principal objects of the invention is to provide an installation tool and a method of using the same which will quickly enable a lineman to easily align a threaded end of a tap reducing plug with a threaded cable connector located in a visible-break "T" type connector housing. By thus allowing for easy alignment, the plug can be threaded into the cable connector without cross-threading.

The invention thus provides an installation tool comprising an elongated shaft having a threaded section and a blunt section, the tool having a threaded opening in one end and a hex opening in the other end. The installation tool is used to assemble by the following method a loadbreak reducing tap plug including a threaded mounting bolt mounted in the threaded end of the plug, and a threaded cable connector mounted in a visible-break "T" type connector housing. The method includes the steps of turning the threaded mounting bolt into the threaded opening of the installation tool, turning the tool threaded section into the cable connector, turning the tap plug into the cable connector, and removing the tool from the cable connector.

In one embodiment of the invention, the threaded mounting bolt is movable both radially and longitudinally relative to the plug, and the method comprises turning the mounting bolt, while the plug is stationary, into a threaded opening in one end of the installation tool. Turning, while the plug is still stationary, the tool blunt section and then the threaded section into and through the cable connector to where the threaded end of the plug can now be turned into the cable connector. Turning, while the installation tool and mounting bolt are stationary, the tap plug into the cable connector. And removing, while the mounting bolt is stationary, the tool from the cable connector and the mounting bolt by inserting a removable tool having a hex end into a hex opening in the end of the installation tool opposite the end having the threaded opening.

Various other features of the invention will become apparent after reviewing the appended drawings, specification and patent claims.

IN THE DRAWINGS

Figures 1, 2, 3, 4, 5:
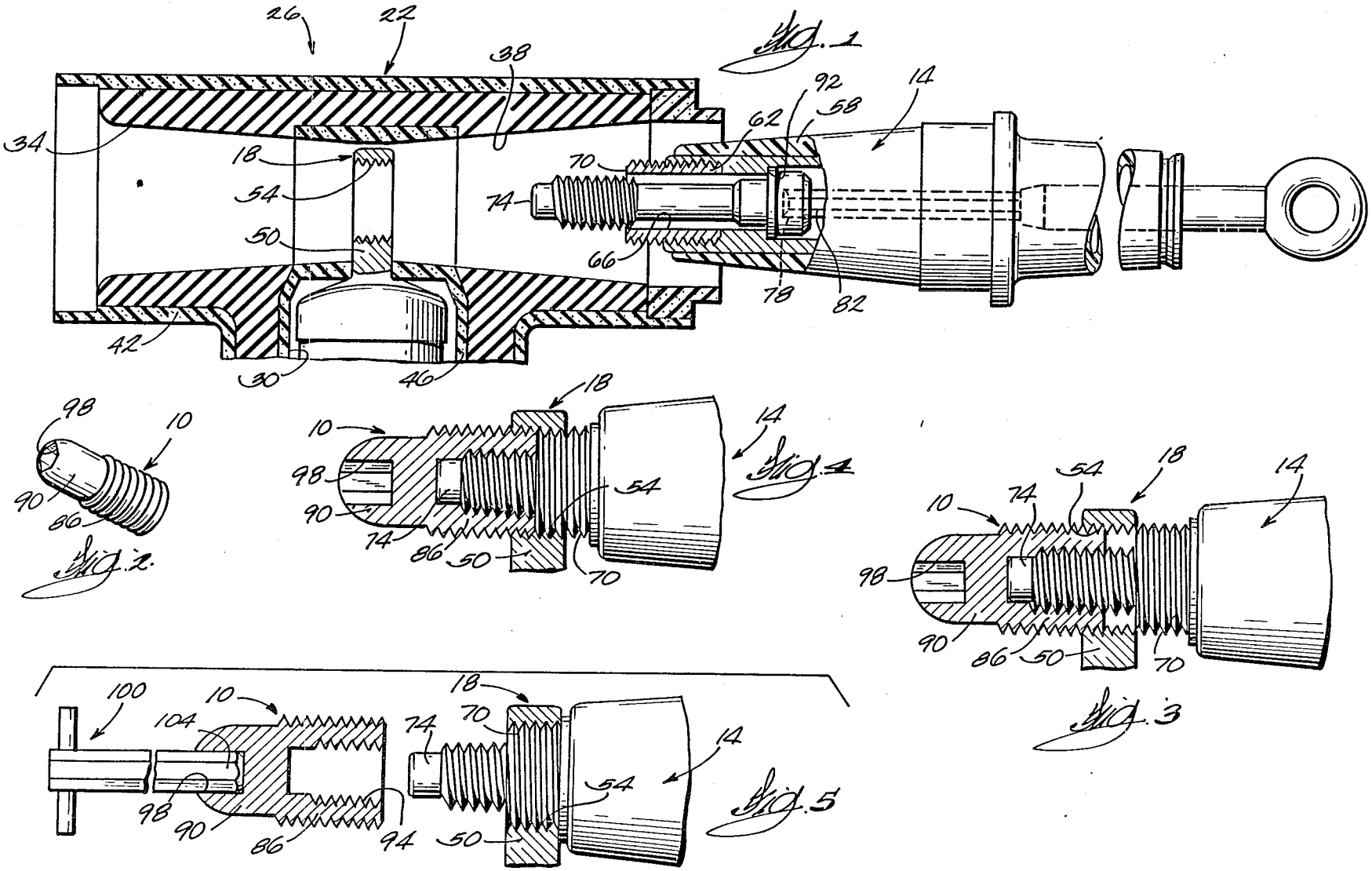
FIG. 1 is a perspective view, partially in section, of a load reducing tap plug and a visible-break "T" type connector housing.
FIG. 2 is a reduced perspective view of an installation tool which embodies various of the features of the invention.
FIG. 3 is a view, partially in cross section, of the installation tool turned onto the end of a mounting bolt in the load reducing tap plug and partially threaded through a cable connector in the visible-break "T" type connector housing.
FIG. 4 is a view, partially in cross section, showing the tap plug threaded into the cable connector.
FIG. 5 is a view, partially in cross section, showing the tap plug completely threaded into the cable connector and the installation tool removed from the mounting bolt by a removal tool.

Before one embodiment of the invention is explained in detail, it is to be understood that the invention is not limited in its application to the details of construction and the arrangement of components set forth in the folloing description or illustrated in the drawings. The invention is capable of other embodiments and of being practiced or carried out in various ways. Also, it is to be understood that the phraseology and terminology used herein is for the purpose of description and should not be regarded as limiting.

DETAILED DESCRIPTION OF THE PREFERRED EMBODIMENT

Illustrated in the drawings is an installation tool 10 for aligning a loadbreak reducing tap plug 14 with a cable connector 18 located in a visible-break "T" type connector 26.

The visible-break "T" type connector 26 includes a dielectric housing 22 of conventional configuration, having a cable opening 30, a bushing interface opening 34, and a plug interface opening 38. A conductive sheath 42 is provided on the outer surface of the housing 22 and a conductive liner 46 is provided in the cable opening 30. A high voltage cable (not shown) is inserted into the cable opening 30 and the cable connector 18 is mounted on the cable. The cable connector 18 includes a lug 50 having a threaded opening 54, and the opening 54 is aligned with the bushing interface opening 34 and the plug interface opening 38.

The loadbreak reducing tap plug 14 is also of conventional configuration having a dielectric housing 58 which has an outer configuration corresponding to the plug interface opening 38. An end 70 of the plug 14 is formed by a threaded electrically conductive tubular member 62 having an axial opening 66. The threaded end 70 of the tap plug 14 or the tubular member 62 is adapted to be received in the threaded opening 54 provided in the cable connector lug 50. A threaded mounting bolt 74 is provided in the axial opening 66 for attaching the loadbreak reducing tap plug 14 and "T" type connector 26 to a transformer bushing (not shown). A wrenching opening 78 is provided in the head of the mounting bolt 74 to accommodate a torque tool 82 for turning the mounting bolt 74. The mounting bolt 74 is freely rotatable within the plug 14, and movable longitudinally to the right (as shown in FIG. 1) without any appreciable restriction. Movement of the bolt 74 to the left (as shown in FIG. 1) is restricted when the head of the bolt 74 abuts the stop 92 inside the axial opening 66.

The installation tool 10 is an elongated member or shaft having a threaded section or end 86 and a blunt section or end 90. The threaded end 86 of the tool 10 has located therein a threaded opening 94 corresponding to the threaded end of the mounting bolt 74. The blunt end 90 of the installation tool 10 has a hex opening 98 therein for receiving a removal tool 100 having a corresponding hex end 104.

The installation tool 10 is used for aligning and threading the threaded end 70 of the loadbreak reducing tap plug 14 with and into the threaded opening 54 in the cable connector 18 mounted in the visible-break "T" connector assembly 26 by use of the following method.

Starting with the plug 14 as shown in FIG. 1, the wrenching tool 82 is inserted into the plug as shown. After the insertion of the wrenching tool 82 into the head of the mounting bolt 74, the mounting bolt 74 is inserted into the installation tool 10 by turning the bolt 74, while the plug 14 is stationary, into the threaded opening 94 in the threaded end 86 of the installation tool 10. The mounting bolt 74 is turned until it seats inside the opening 74 in the installation tool 10. The blunt end 90 of the installation tool 10 is then located inside the opening 54 in the lug 50 on the cable connector 18. The wrenching tool 82 is then turned, while the plug end 70 is stationary, to where the mounting bolt 74 and the installation tool 10 are threaded through the connector opening 54 (See FIG. 3) to the point where the mounting bolt head abuts the stop 92 inside the end 70 of the plug 14, as shown in FIG. 1. At this point, the plug end 70 abuts the lug 50 (as shown in FIG. 3) and about a ¼ inch space is between the threaded end 70 of the tap reducing tap plug 14 and the adjacent threaded end 86 of the installation tool 10. In other words, the tool 10 has now been turned into and through the cable connector 18 to where the threaded end 70 of the loadbreak reducing tap plug 14 can now be turned into the cable connector 18. Next, an operator turns the load reducing tap plug 14 and threads the threaded end 70 of the tap plug 14 into the cable connector 18 to where the tap plug 14 abuts the installation tool 10 (See FIG. 4). The removal tool 100 is now inserted through the bushing opening 34 in the connector housing 22 and the installation tool 10 is turned and removed from the connection opening 54 and the mounting bolt 74 while the mounting bolt 74 is held stationary by the wrenching tool 82. At this point, the tap plug 14 is properly aligned with and partially threaded into the cable connector 18 and the operator can continue to turn the tap plug 14 and complete the threading of the end 70 of the tap plug 14 into the threaded opening 54 in the cable connector 18. The operator may now connect the assembled connector 26 and tap plug 14 to the bushing (not shown) by turning the mounting bolt 74 with the wrenching tool 82 into a threaded opening (not shown) in the bushing (not shown).

Various of the features of the invention are set forth in the following claims.

I claim:

1. A method for aligning and threading a threaded end of a loadbreak reducing tap plug with and into a threaded opening in a cable connector mounted in a connector housing, the plug including a threaded mounting bolt mounted in the threaded end of the plug, said method comprising:

turning the threaded mounting bolt into a threaded opening in an installation tool including a shaft having a threaded section, turning the tool threaded section into the cable connector, turning the tap plug into the cable connector, and removing the tool from the cable connector.

2. A method for aligning and threading a threaded end of a loadbreak reducing tap plug with and into a threaded opening in a cable connector mounted in a visisble-break "T" connector housing, the plug including a threaded mounting bolt mounted in the threaded end of the plug, and movable both radially and longitudinally relative to the plug, said method comprising:

turning, while the plug is stationary, the mounting bolt into a threaded opening in one end of an installation tool including an elognated shaft having a threaded section and a blunt section, turning, while the plug is still stationary, the tool blunt section and then the threaded section into and through the cable connector to where the threaded end of the plug can now be tunrned into the cable connector, turning, while the installation tool and mounting bolt is stationary, the tap plug into the cable connector, and removing, while the mounting bolt is stationary, the tool from the cable connector and the mounting bolt by inserting a removal tool having a hex end into a hex opening in the end of the installation tool opposite said end having said threaded opening.

* * * * *